US006235159B1

(12) United States Patent
Waech et al.

(10) Patent No.: US 6,235,159 B1
(45) Date of Patent: May 22, 2001

(54) CONVERGENT FLOW HEADBOX

(75) Inventors: Theodore G. Waech, Janesville; Daniel H. Sze, Beloit, both of WI (US)

(73) Assignee: Beloit Technologies, Inc., Wilmington, DE (US)

( * ) Notice: Subject to any disclaimer, the term of this patent is extended or adjusted under 35 U.S.C. 154(b) by 0 days.

(21) Appl. No.: 09/260,347

(22) Filed: Mar. 2, 1999

Related U.S. Application Data

(63) Continuation-in-part of application No. 08/661,274, filed on Jun. 10, 1996, now Pat. No. 5,882,482.

(51) Int. Cl.[7] ..... D21F 1/02
(52) U.S. Cl. ..... 162/336; 162/339; 162/343
(58) Field of Search ..... 162/336, 339, 162/343, 344, 347

(56) References Cited

U.S. PATENT DOCUMENTS

| | | |
|---|---|---|
| 3,652,392 | 3/1972 | Appel . |
| 3,945,882 | 3/1976 | Egelhof et al. . |
| 4,146,427 | 3/1979 | Högel et al. . |
| 4,770,745 | 9/1988 | Hildebrand et al. . |
| 4,824,524 | 4/1989 | Hildebrand . |
| 4,888,094 | 12/1989 | Weisshuhn et al. . |
| 4,897,158 | 1/1990 | Weisshuhn et al. . |
| 4,898,643 | 2/1990 | Weisshuhn et al. . |
| 4,906,336 | 3/1990 | Weisshuhn et al. . |
| 5,167,770 | 12/1992 | Bubik et al. . |
| 5,196,091 | 3/1993 | Hergert . |
| 5,298,126 | 3/1994 | Dahl . |
| 5,431,785 | 7/1995 | Bubik et al. . |

FOREIGN PATENT DOCUMENTS

| | | |
|---|---|---|
| 97/47805 | 12/1997 | (WO) . |

*Primary Examiner*—Peter Chin
*Assistant Examiner*—Mark Halpern
(74) *Attorney, Agent, or Firm*—Lathrop & Clark LLP

(57) ABSTRACT

A headbox having a tube bank composed of a multiplicity of tubes arranged in machine direction rows of superpositioned tubes. The tubes extend from an unitary outlet wall of the headbox and are supplied by a single header or manifold. The tubes extend to the inlet of a single nozzle which is formed with an upper planar wall which converges toward a lower planar wall. The converging walls of the nozzle define two radially extending planes which converge at an imaginary centerline which extends in the cross-machine direction. The individual rows of tubes each lie along a radial plane which extends through the centerline. The radial planes defined by each tube row will preferably be evenly spaced in angle between the nozzle walls. The injection ends of the tubes lie on a defined cylindrical surface extending between the nozzle walls and extending the width of the headbox in the cross machine direction.

9 Claims, 8 Drawing Sheets

CONVERGENT FLOW HEADBOX

CROSS REFERENCES TO RELATED APPLICATIONS

This application is a continuation-in-part of U.S. patent application Ser. No. 08/661,274 filed Jun. 10, 1996, now U.S. Pat. No. 5,882,482 which is incorporated herein by reference.

STATEMENT AS TO RIGHTS TO INVENTIONS MADE UNDER FEDERALLY SPONSORED RESEARCH AND DEVELOPMENT

BACKGROUND OF THE INVENTION

The present invention relates to papermaking headbox apparatus for causing a uniform flow of papermaking stock to flow through a slice onto a forming wire.

Paper is made of individual fibers which are deposited in a continuous sheet. The sheet is typically formed from a papermaking stock containing about than 1 percent paper fibers dispersed in more than 99 percent water. The fibers and water are deposited onto a wire screen or screens in the former section of the paper machine to form a continuous web of paper. The papermaking stock is first fed to a headbox which distributes the stock across the width of the forming screen or screens on which the paper web is being formed. The headbox discharges the stock through a long converging nozzle or slice which injects the stock onto the rapidly moving wire screen or between two screens. The fibers are largely retained on the wire surface while the majority of the water is drawn through the screen or screens. The former may be a single wire horizontal former (Fourdrinier) or a two wire (twin wire) former. The paper web thus formed is pressed, dried and wound into reels. The reels of paper formed on the papermaking machine are then further processed to produce smaller rolls or sets of paper for printing. Individual sheets are also made which may be used in sheet-fed printing presses, in copy machines, and in laser printers.

Because paper is made of individual paper fibers which are joined together during the pressing and drying process, the orientation of the fibers within the paper controls the physical properties of the paper. In particular, fiber orientation influences the strength and dimensional stability of the paper. It has been found that paper which has insufficiently uniform fiber orientation, when exposed to heat or moisture, will form more wrinkles or become more wavy than normal. Exposing paper to heat or moisture causes the paper to shrink or expand. It is the non-uniformity of the dimensional changes which causes the paper to wrinkle or ruck. Non-uniformities in the paper are in turn caused by fiber alignment streaks and other defects caused by non-uniformity of the flow of stock onto the wire or wires.

Printing presses, converting equipment and papermaking machines are increasing in speed. This means they are more sensitive to small instabilities in the paper web such as those caused by non-uniform dimensional changes in the paper. The instabilities can lead to web breaks or print quality problems. The printing industry in newspapers, magazines and books continues to use more and more color which results in more water or other liquids coming in contact with the paper web where they can release dried-in stresses which bring out the dimensional instability of the paper and cause it to wrinkle. At the same time, increased moisture decreases the paper strength making it more subject to breaking.

Further, the consuming public has come to expect not only more color printing but printing of higher quality. Slight cockling or warping of the paper can lead to unprinted areas. Where glossy paper is utilized, waviness or cockle results in non-uniform reflection which is distracting to the consumer.

The fact that a sheet or web of paper can become wavy upon exposure to moisture or heat has thus become of greater concern. Most processes which form an image upon paper employ heat or moisture. When paper in sheet form is processed through a photocopier, laser printer, or printing press, warping of the sheet may cause it to jam the machine and cause a significant loss of productive time. When paper in the form of a continuous web becomes wrinkled, it is liable to break. Breakage of a web within a printing press, in a winder, or on a coater, can cause significant down time as well as the loss of significant quantities of paper.

The problem of dimensional changes in finished paper is aggravated by the trend to use lower base weight paper to hold down paper costs. Lighter grade papers are more subject to press breakage or jamming. A lighter grade of paper also means that for a given amount of moisture transferred by printing, particularly of colored images, a greater percentage of moisture is introduced into the paper. The increased productivity of modern equipment means that even limited down time to clear a jam or rethread a broken web can have significant economic consequences in terms of lost production. Further, paper must lie flat for easier handling, loading and compact transportation.

The papermaking machine headbox and the slice contribute significantly to the uniformity with which the fibers are laid down to form a paper web. Improvements in headbox design are essential to meet the growing expectations of paper consumers for flatter, more dimensionally stable paper.

Various means for controlling flow and scale of the turbulence produced in a headbox between the stock input header and the slice gap or opening are known. One known type of headbox employs a bank of parallel tubes which employ small scale turbulence generators and pressure drop features to assure a more uniform flow of stock into the nozzle and from the slice opening onto the forming wire.

A headbox is shown in U.S. Pat. No. 4,898,643 to Weisshuhn, et al. which employs two series connected tube banks which are separated by an intermediate space which is connected to a control means. The second set of diffuser tubes connects the intermediate space with the slice by means of a diffuser tube system which appears to converge toward the nozzle. Weisshuhn, et al. does not disclose continuous banks of tubes extending between the headbox and the converging slice.

In forming multi-ply paper webs, conventional headboxes have been mounted together to form a single sheet of paper or linerboard having multiple layers of fiber. When multiple headboxes are mounted together each headbox is pointed to a common injection axis. U.S. Pat. No. 5,431,785 to Bubik et al. shows a logical extension of this practice using a plurality of headboxes to form a multi-ply sheet. Bubik et al. discloses a headbox for forming a multi-ply web wherein three distinct slice chambers are each fed by a separate tube bank. Each tube bank is fed by a separate stock supply header so that different types of stock may be supplied to form the various layers of the multi-ply web. Bubik et al. teaches decreasing the angle at which the jets of stock meet after they leave their respective nozzle.

U.S. Pat. No. 3,65,392 to Appel discloses an old style headbox employing a pond and the upper wall of the nozzle is not continuous but rather changes in orientation as it approaches the slice opening.

What is needed is a headbox which deposits a more uniform mat of fibers onto a forming wire.

SUMMARY OF THE INVENTION

The headbox of this invention employs a tube bank composed of a multiplicity of tubes arranged in machine direction rows of superpositioned tubes. The tubes extend from an unitary outlet wall of a headbox supplied by a single header or manifold. The tubes extend to the inlet of a single nozzle which is formed with an upper planar wall which converges toward a lower planar wall. The converging walls of the nozzle define two radially extending planes which converge at an imaginary centerline which extends in the cross-machine direction. The individual rows of tubes each lie along a radial plane which extends through the centerline. The radial planes defined by each tube row will preferably be evenly spaced between the nozzle walls. The injection ends of the tubes lie on a defined cylindrical surface extending between the nozzle walls and extending the width of the headbox in the cross machine direction. Thus the path of stock from each tube is normal to the centerline and the distance between each tube row and the centerline will be the same. Thus the flow of stock from the outlet of each tube in the tube bank to the nozzle discharge opening will traverse the same distance and will experience no change in direction but only acceleration due to the convergence of the nozzle. Trailing vanes may be positioned between the channels so that each flow experiences almost identical flow boundary conditions as it moves toward the nozzle.

It is a feature of the present invention to provide a headbox which has greater stock flow uniformity within the nozzle.

It is another feature of the present invention to provide a headbox for a papermaking machine which produces paper with greater dimensional stability.

It is a further feature of the present invention to provide a headbox for injecting a stream of stock for forming a paper web in which the paper fibers are more uniform in fiber orientation angles.

It is a yet further feature of the present invention to provide a headbox for injecting a stream of stock of greater uniformity between twin wires.

Further objects, features and advantages of the invention will be apparent from the following detailed description when taken in conjunction with the accompanying drawings.

DESCRIPTION OF THE PREFERRED EMBODIMENTS

Figure 1:
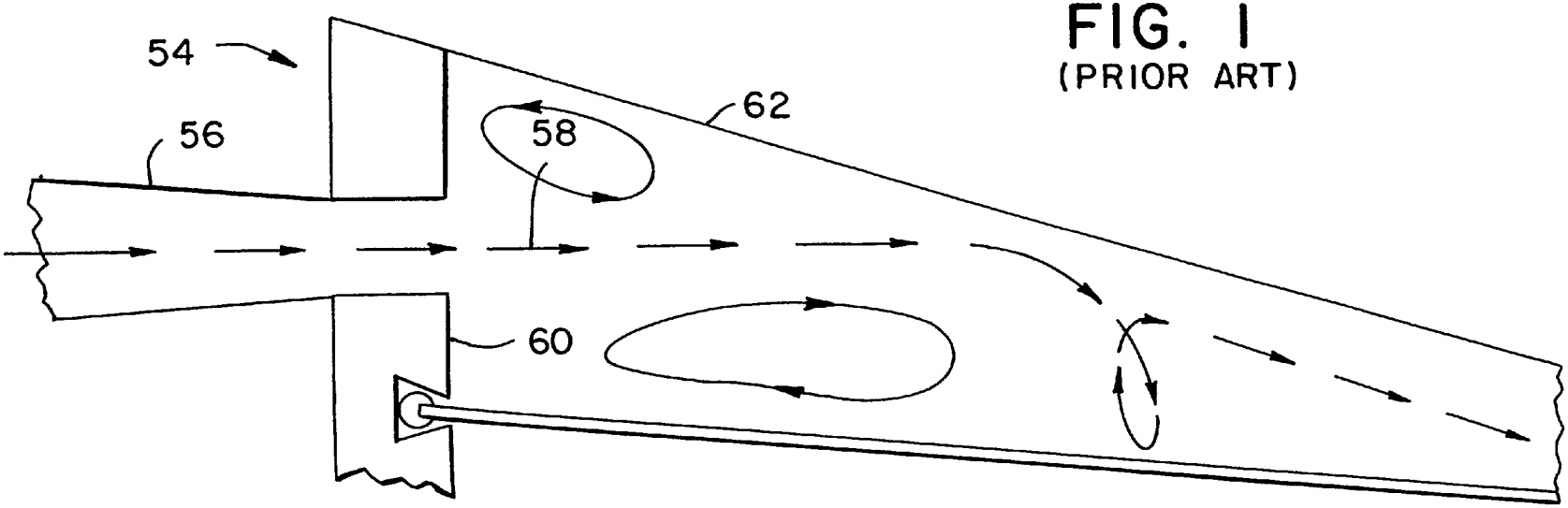
FIG. 1 (PRIOR ART)
FIG. 1 is a schematic view of a prior art head box nozzle showing a streamline from a single stock injection tube impacting the wall of a nozzle and producing turbulence.
Figure 2:
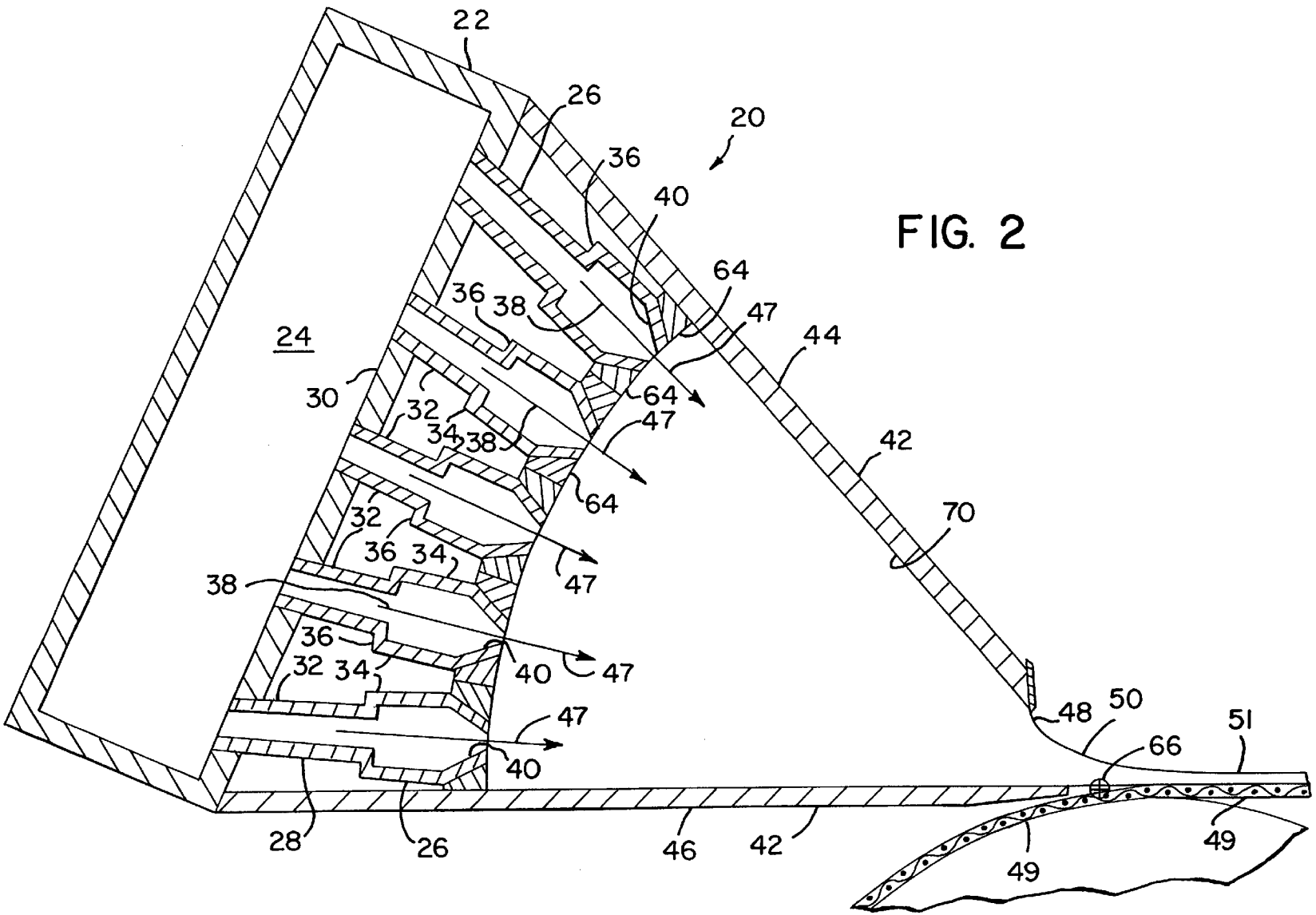
FIG. 2 is an exaggerated schematic view showing a headbox of this invention.
Figure 3:
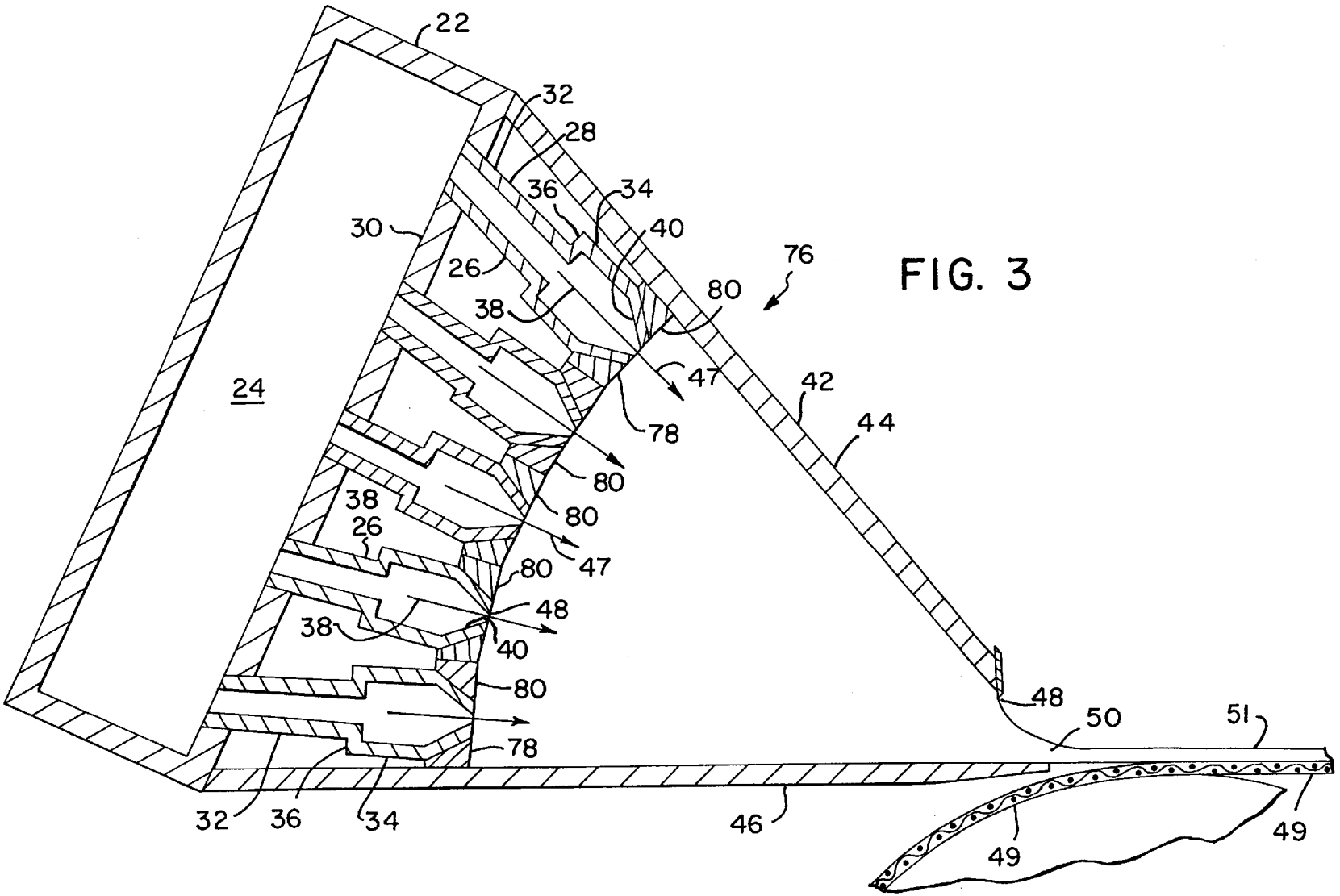
FIG. 3 is an alternative embodiment headbox of this invention having an injection face composed of angular plates.
Figure 4:
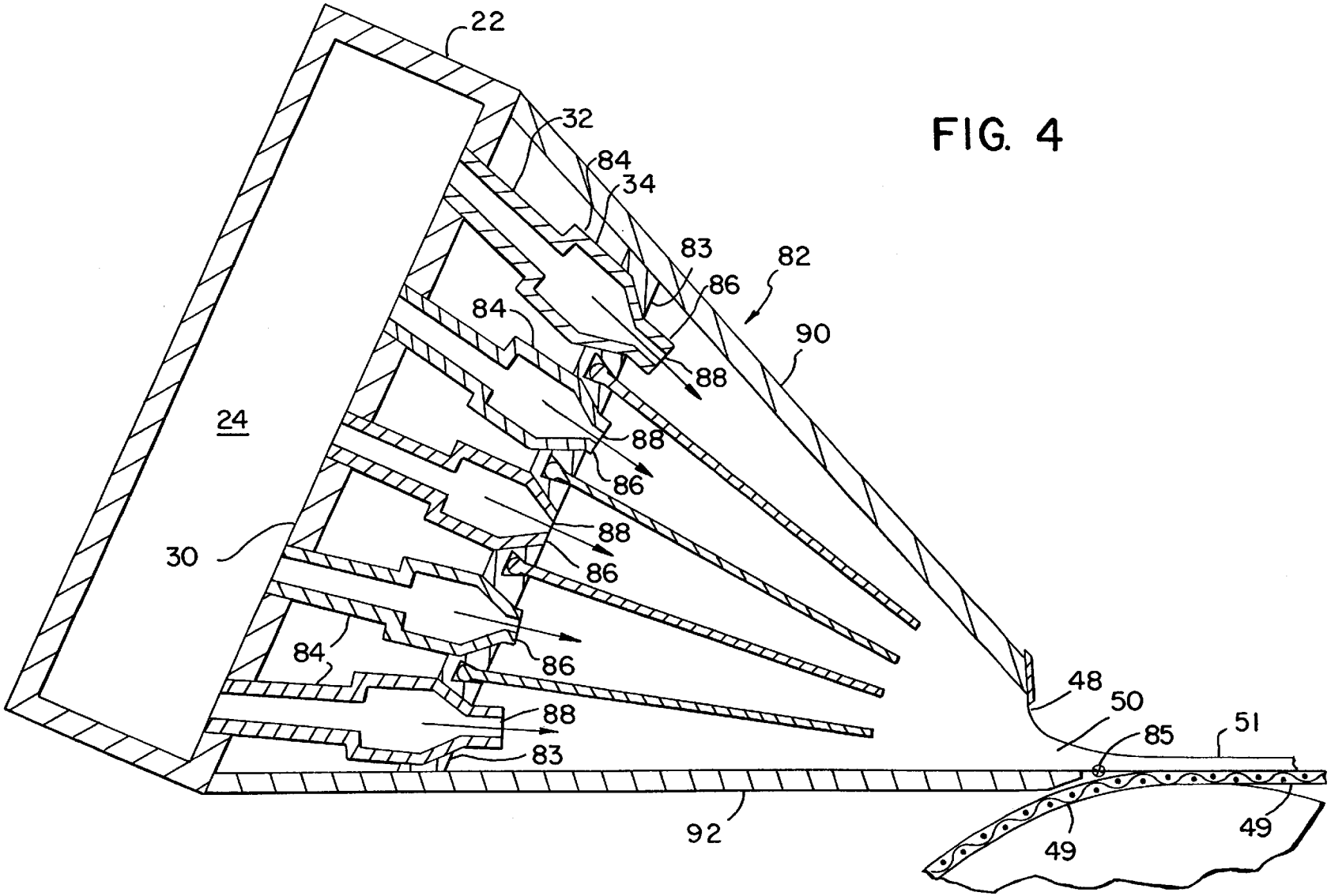
FIG. 4 is an alternative embodiment headbox of this invention having a planar injection surface and injection tube outlets which are pointed toward a centerline.

Referring more particularly to FIGS. 1–8 wherein like numbers refer to similar parts, a headbox 20 is shown in FIG. 2. The headboxes in FIGS. 2–4 are shown in schematic cross-section taken in the machine direction. The headbox 20 of FIG. 2 has a single unitary manifold or header 22 which provides a means for distributing an infed stock across the width of the web 51. The headbox 20 is designed to form a single-ply web. The single header 22 supplies stock 24 to all the individual stock supply tubes 26. The single unitary header 22 has an inlet (not shown) and an outlet (not shown) and extends in the cross-machine direction. The unitary header 22 is typically tapered either linearly or parabolically from the inlet to the outlet. Each tube 26 in the tube bank 28 is supplied with the same flow of stock 24 by the single header 22. The tube bank provides a means for conveying the stock between the single header 22 and the nozzle 42.

The header 22 has a single unitary outlet wall 30 through which the stock flows into individual tubes 26. The tubes shown schematically in FIG. 2 are typically configured with a narrow section 32 joined to a wider section 34 by an abrupt transition section 36. The transition section 36 introduces small scale turbulence into the stock flowing through the tube 26. The transition section 36 also results in a hydraulic pressure drop which serves to isolate the flow 38 through the tubes 26 from upstream pressure disturbances in the header 22. Each tube 26 also has a converging section 40 downstream of the transition section 36 which spreads the flow out in a cross-machine direction and injects the flow 38 into a nozzle 42.

The nozzle 42 provides a means for forming a paper web by discharging a converging flow of stock and is formed by a planar upper wall 44 which is spaced above and which converges toward a planar lower wall 46. The nozzle walls 44, 46 converge toward an outlet 48 where the stock 24 is ejected in a jet 50 which delivers stock 24 to a paper machine wire 49 on which a paper web 51 is formed. Individual vanes 52 may be positioned within the nozzle between rows of tubes 26. The vanes 52 extend in the machine direction.

FIG. 1 shows a detail of a prior art headbox 54. The prior art tube 56 injects a stream 58 of papermaking stock perpendicular to the stock inlet plate 60. The stream 58 is thus angled toward the upper nozzle wall 62, also known as the headbox roof. This stream impinges on the nozzle roof, thereby causing a flow with a bent path. The resistance to flow of the stock adjacent the upper and lower nozzle walls are thus greater than stock discharged from intermediate tubes, because of the longer path length and greater angle. This interaction of the jet 58 with the nozzle walls 62 can thus result in large scale turbulence and hence energy loss in the stream 58. Loss of pressure or velocity in the streams near the walls results in undesirable turbulence when the outer streams are joined with central streams which have higher velocities and pressures. Such disturbances may result in variations in fiber orientation and a web of paper which is more disposed to wrinkling. This variation in flow conditions for different segments of the flow can cause streaks with an average fiber alignment larger or smaller than normal which cause wavy paper after moistening or heating. Increased waviness or cockle can cause a number of problems in paper, among them nonprintable areas or image deletion, nonuniform reflections from glossy stocks, and poor lie-flat characteristics.

As shown in FIG. 2, the headbox 20 of this invention reduces undesired turbulence by angling each row of tubes 26 with respect to adjacent rows of tubes such that each tube 26 ejects a stream of stock perpendicular to a curved injection face 64. Each tube thus extends radially with respect to an imaginary cross-machine direction centerline 66 defined by intersecting planes extending from the nozzle upper wall 44 and the nozzle lower wall 46. The centerline 66 is positioned parallel to the nozzle outlet 48. The curved face 64 defines a sector of a cylindrical shell which extends in the cross-machine direction and is curved in the z-direction. The z-direction is perpendicular to the cross machine direction and to the machine direction (or main flow direction). The curvature of the curved face 64 is also defined with respect to the imaginary center line 66.

Cellulose fibers have a natural tendency to clump or flocculate which is undesirable because it can affect the uniformity of the paper formed from the stock. Although diluting the stock tends to reduce the tendency for the paper fibers to flocculate, the dilution required to prevent flocculation would result in the need for an impractical quantity of stock to form the paper web. Thus, the flocculation must be controlled through the use of small scale turbulence which produces shear within the flow of stock that breaks up and prevents the formation of flocculent. Large scale turbulence, however, introduces nonuniform hydrodynamic forces which can align the paper fibers in elongated flocs within the stock flow. Large scale turbulence results in fiber alignment streaks which are responsible for defects which result in the wrinkling of the formed paper when subjected to heat or moisture.

Figure 5:
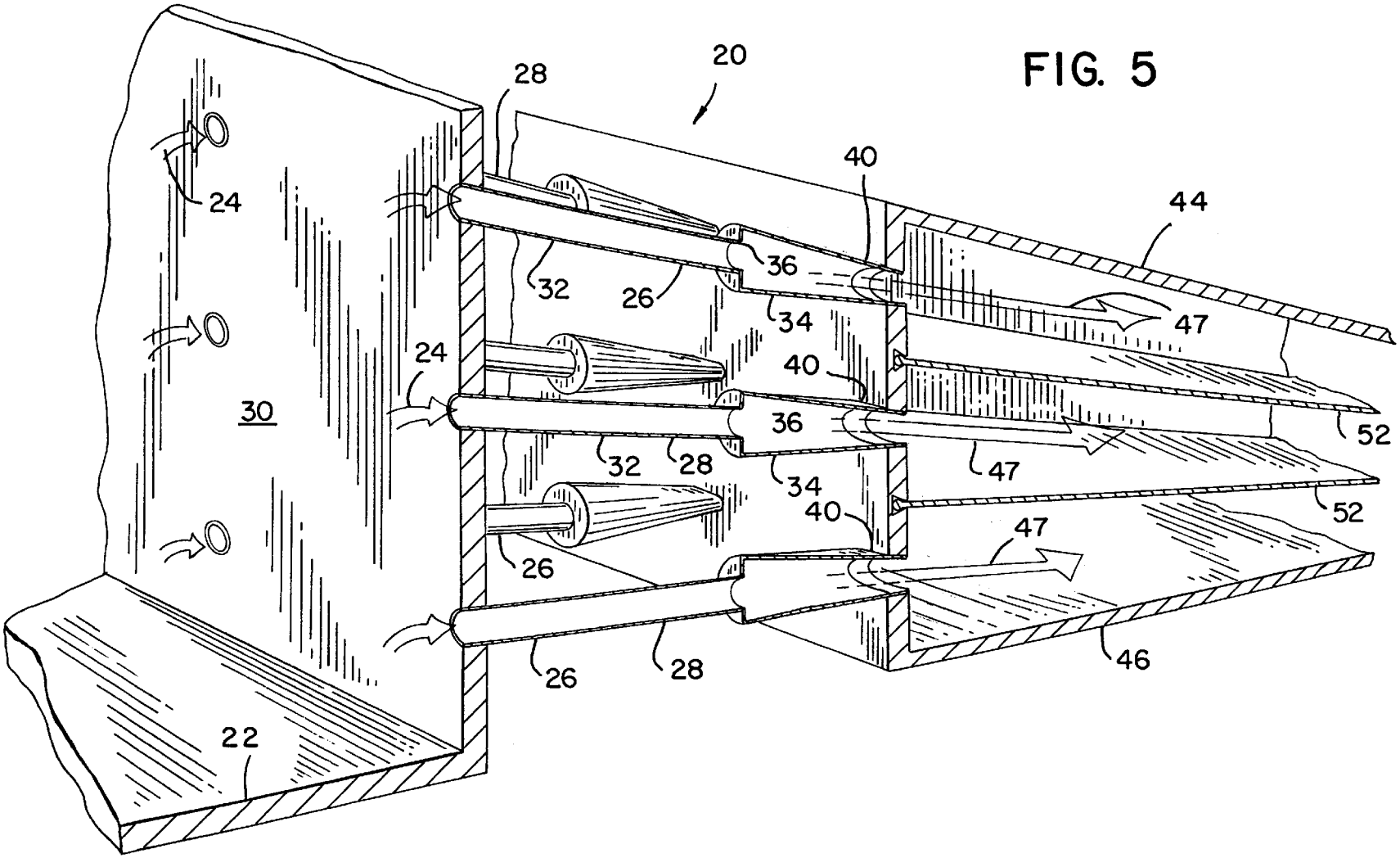
FIG. 5 is a fragmentary isometric view, cut away in section, of a simplified version of the headbox of FIG. 2.

As shown in FIG. 2, each of the tubes 26 directs a stream or jet 47 of stock toward the centerline 66. The nozzle chamber 42 may be divided by vanes 52 such as shown in FIG. 5 into substantially equivalent divisions but such vanes, while helpful, are not necessary.

The increased fiber orientation uniformity of the paper produced by the headbox of this invention becomes of increasing importance with the increasing trend to papers which are lower in basis weight, glossier, subjected to multiple printing impressions, and both made and printed much faster. This uniformity is especially called for as consumers of paper become more demanding of higher quality, less wavy printing and readability of their paper stock.

An alternative embodiment headbox 76 is shown in FIG. 3. The headbox 76 has an injection face 78 which is not curved, but is instead made up of discrete planar segments 80 which approximate a curved surface. The segments 80 extend the length of the headbox in the cross-machine direction. Each segment is perpendicular to a plane which extends radially from the centerline. An injection face of this construction may be easier to fabricate in certain circumstances.

Another alternative embodiment headbox 82 is shown in FIG. 4. The headbox 82 has a planar injection face 83 which extends substantially in the z direction. The tubes 84 of the tube bank are each angled toward an imaginary center line 85 defined by the intersection of the planes extending from the upper and lower nozzle walls 90, 92. The ends 86 of the tubes may extend into the nozzle so that the stock discharge openings of the tubes 84 are equidistant from the centerline 85. The headbox 82 thus has generally radially extending tubes which discharge stock along paths which are substantially identical.

Figure 6:
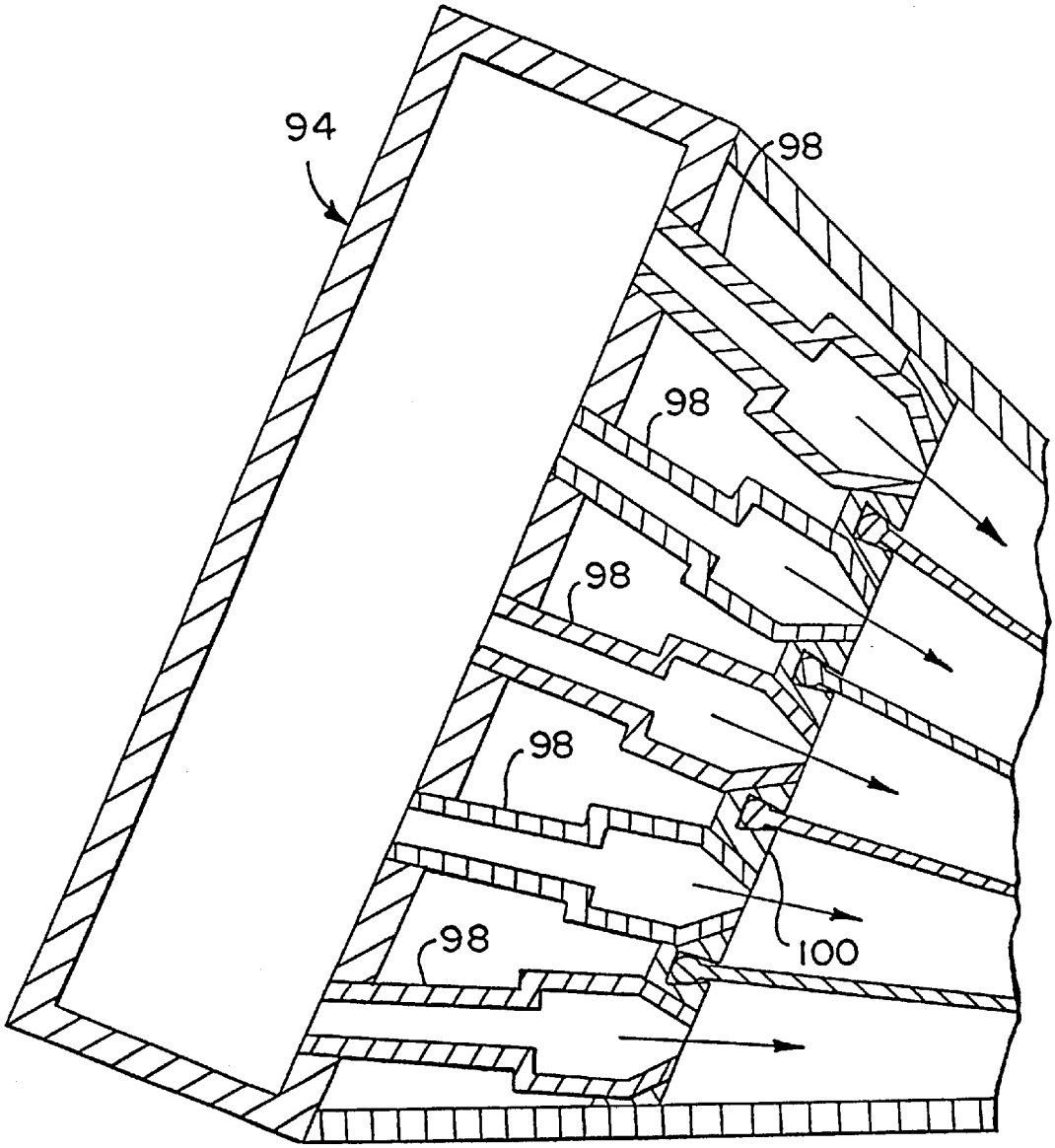
FIG. 6 is a fragmentary view of another alternative embodiment headbox of this invention.
Figure 7:
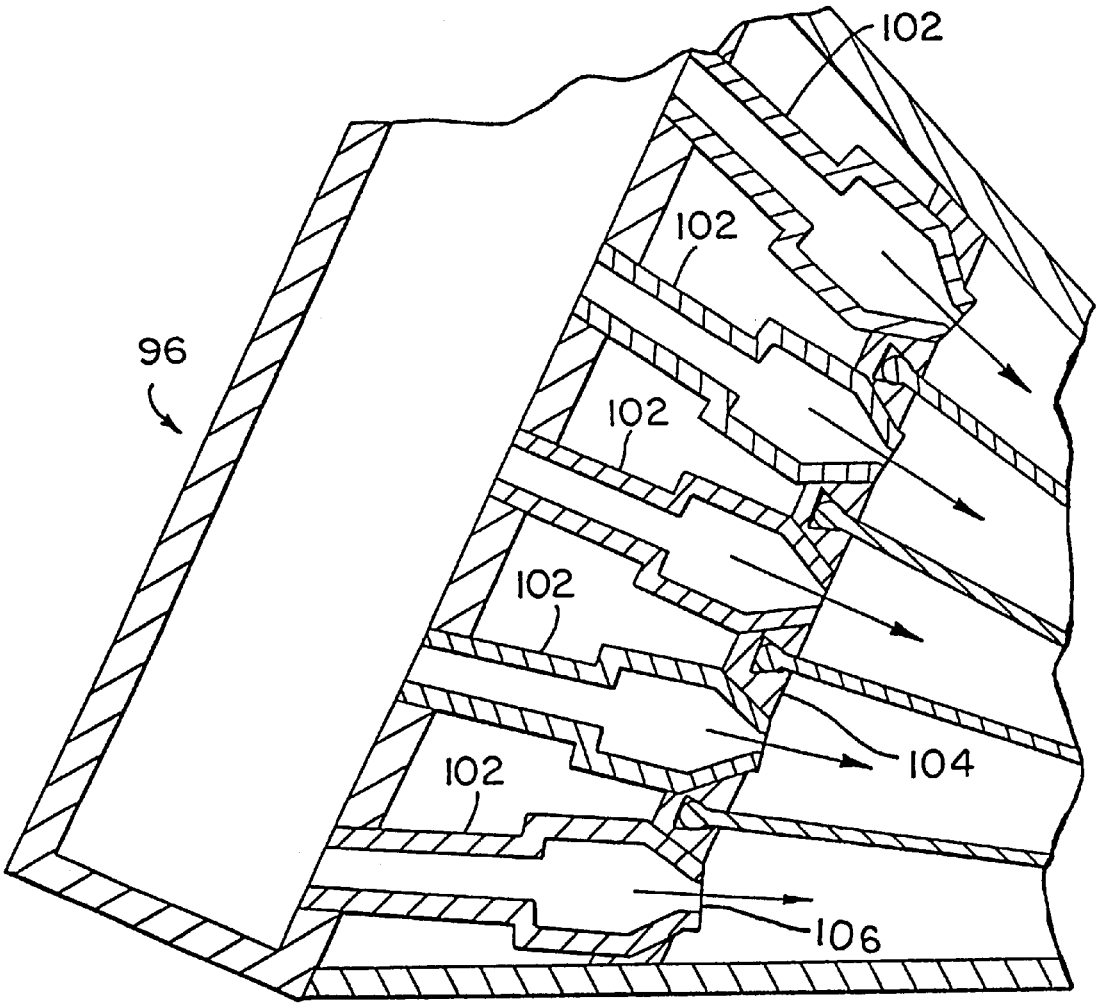
FIG. 7 is a fragmentary view of yet another alternative embodiment headbox of this invention.

Alternatively, a headbox of this invention may be formed with path lengths which are not identical, as shown in the headboxes 94, shown in FIG. 6, and 96 shown in FIG. 7. The headbox 94 has tubes 98 which terminate at the planar injection face or discharge wall 100 and are flush with the discharge wall. The head box 96, shown in FIG. 7 has tubes 102 which although angled from the planar injection face or discharge wall 104, extend from the injection face 104 a minimal amount to permit the stock openings 106 of the tubes 102 to retain their cylindrical shape.

Figure 8:
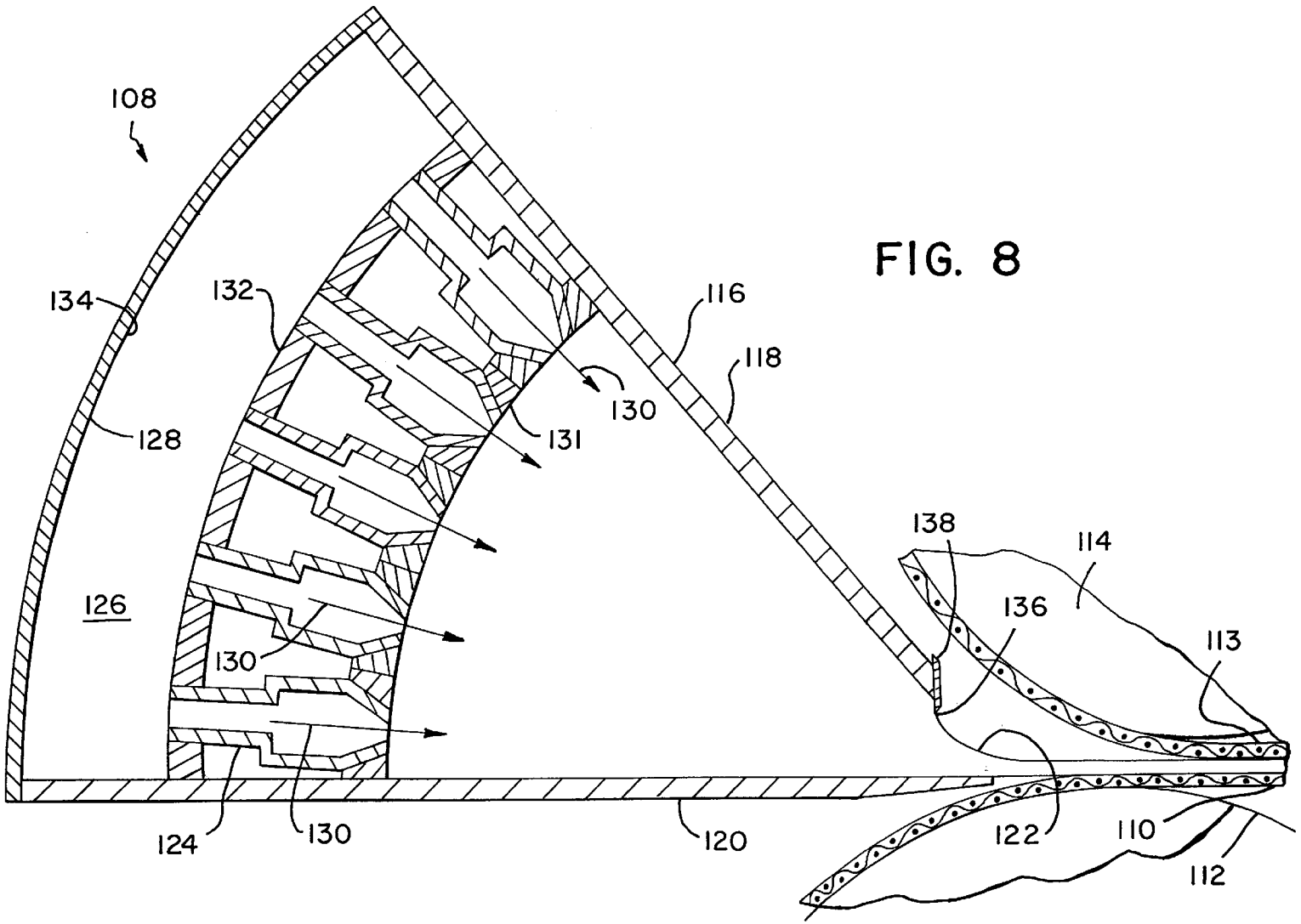
FIG. 8 is cross-sectional view of another alternative embodiment headbox of this invention for injecting stock between twin wires.

FIG. 8 shows a headbox 108 positioned between a first forming fabric 110 which turns over a first breast roll 112, and a second forming fabric 113 which turns over a second breast roll 114 to form a pair of converging forming fabrics or wires. A nozzle 116 formed by an upper wall 118 and a lower wall 120 projects a jet 122 of stock between the forming fabrics 110, 113. Tubes 124 similar to those shown in FIGS. 2–7 receive stock 126 from a header 128 and direct it along converging lines indicated by arrows 130. The headbox 108 has a curved injection face 131 positioned between the upper wall 118 and the lower wall 120 through which stock is injected into the nozzle 1 16. The curved injection face 131 has a shape similar to the curved injection face 64 shown in FIG. 2.

The header 128 has an outlet wall 132 which has the shape of a portion of a cylinder. The outlet wall 132 has a cylindrical axis which is coincident with an imaginary center line defined by the intersection of planes containing the upper wall 118 and the lower wall 120. The back wall 134 of the header 128 may also be curved or may be planar or may have a number of planar segments which approximate a cylinder. The curve of the discharge wall allows all the tubes 124 to be of the same length, which will facilitate a uniform flow of stock into the nozzle 116.

At the outlet 136 an adjustable slice lip 138 positioned on the upper wall 118 may be used to adjust the flow of stock from the headbox 108. Vanes (not shown) similar to those shown in FIG. 2 may be placed between rows of tubes 124.

It should be noted that the headboxes and nozzles of this invention have been shown in the figures in a foreshortened manner to emphasize the converging nature of the tubes. The convergent angles of the nozzles have been exaggerated to more clearly emphasize that the individual tubes making up the rows of tubes are directed toward a single line 66 which extends in the cross-machine direction. The line 66 is defined by the intersection of planes defined by the interior surfaces of upper and lower walls of the nozzle. The actual length to height proportions of the nozzle and tube bank will be substantially those ratios of conventional headbox and nozzle arrangements. An example of such a device is shown in FIG. 1 of U.S. Pat. No. 5,196,091 to Hergert, the disclosure of which is hereby incorporated by reference.

Although tube banks have been shown and described as containing discrete tubes, they may be in the form of holes bored between the inlet plate and the injection face. Where tubes are used, angled holes will be bored in the inlet plates and the individual tubes welded or brazed to the inlet plate of the header.

It will be understood by those skilled in the art that a typical tube bank may be made up of three to nine rows of tubes. The tubes are directed in the machine direction and the rows extend in the cross-machine direction with the individual rows superpositioned in approximately the z direction.

It is understood that the invention is not limited to the particular construction and arrangement of parts herein illustrated and described, but embraces such modified forms thereof as come within the scope of the following claims.

We claim:

1. A headbox apparatus for a papermaking machine for producing a paper web from an infed stock, the headbox apparatus comprising:

a single header for distributing an infed fiber stock across the width of the machine, the header having a single unitary outlet wall;

a tube bank composed of a plurality of tubes, the tubes forming a plurality of stacked rows, wherein each tube extends in the machine direction and extends from the single header along the single unitary outlet wall to receive a flow of stock from the single header; and a nozzle chamber following and in direct flow communication with the header by means of the tube bank, wherein the nozzle chamber receives the stock from the tube bank through a discharge wall, and wherein the nozzle chamber has an upper wall contained within a first single plane which converges toward a lower wall contained within a second single plane, and is spaced from the lower wall to define a slice outlet, and wherein the tubes extend radially along lines which extend from the slice outlet, such that the tubes converge toward the slice outlet;

wherein the first single plane intersects with the second single plane at an imaginary centerline extending in the cross-machine direction and which defines an intersection of said first single plane and said second single plane, and wherein each tube lies in a plane which extends radially from the centerline; and wherein the tubes in each row lie in a single plane.

2. The apparatus of claim 1 wherein the discharge wall is a sector of a cylinder with the axis of said cylinder sector being defined by said imaginary centerline.

3. The apparatus of claim 1 wherein the discharge wall is composed of a plurality of planar segments extending the length of the headbox in the cross-machine direction, and wherein each segment is perpendicular to a plane which extends radially from said centerline.

4. The apparatus of claim 1 wherein the discharge wall is approximately planar such that portions of the wall have greater radial displacement from the centerline than other portions, and wherein each tube has an end which forms a stock opening for discharging stock.

5. The apparatus of claim 4 wherein each tube end is equidistant from the centerline so that tubes which penetrate the discharge wall through the portions of the wall having greater radial displacement extend beyond the wall.

6. The apparatus of claim 1 wherein the single unitary outlet wall has the shape of a portion of a cylinder which defines a cylindrical axis which is coincidental with the centerline.

7. A twin wire former for a papermaking machine for producing a paper web from an infed stock, comprising:

a first breast roll;

a first forming fabric wrapping around the first breast roll;

a second breast roll in spaced parallel relation to the first breast roll; a second forming fabric wrapping around the second breast roll, wherein the first forming fabric and the second forming fabric are brought into a joint parallel run into which a jet of stock is injected;

a headbox forming the jet of stock which is injected, the headbox having a single header for distributing an infed fiber stock across the width of the machine, the header having a single unitary outlet wall;

a tube bank composed of a plurality of tubes, the tubes forming a plurality of stacked rows, wherein each tube extends in the machine direction and extends from the single header along the single unitary outlet wall to receive a flow of stock from the single header; and a nozzle chamber following and in direct flow communication with the header by means of the tube bank, wherein the nozzle chamber receives the stock from the tube bank through a discharge wall, and wherein the nozzle chamber has an upper wall contained within a first single plane which converges toward a lower wall contained within a second single plane, and is spaced from the lower wall to define a slice outlet, and wherein the tubes extend radially along lines which extend from the slice outlet, such that the tubes converge toward the slice outlet;

wherein the first single plane intersects with the second single plane at an imaginary centerline extending in the cross-machine direction and which defines an intersection of said first single plane and said second single plane, and wherein each tube lies in a plane which extends radially from the centerline; and wherein the tubes in each row lie in a single plane.

8. The apparatus of claim 7 wherein the discharge wall is a sector of a cylinder, with the axis of said cylinder sector being defined by said imaginary centerline.

9. A headbox apparatus for a papermaking machine for producing a paper web from an infed stock, the headbox apparatus comprising:

a single header for distributing an infed fiber stock across the width of the machine, the header having a single unitary outlet wall;

a tube bank composed of a plurality of tubes, the tubes forming a plurality of stacked rows, wherein each tube extends in the machine direction and extends from the single header along the single unitary outlet wall to receive a flow of stock from the single header; and a nozzle chamber following and in direct flow communication with the header by means of the tube bank, wherein the nozzle chamber receives the stock from the tube bank through a discharge wall, and wherein the nozzle chamber has an upper wall contained within a first single plane which converges toward a lower wall contained within a second single plane, and is spaced from the lower wall to define a slice outlet, and wherein the tubes extend radially along lines which extend from the slice outlet, such that the tubes converge toward the slice outlet;

wherein the first single plane intersects with the second single plane at an imaginary centerline extending in the cross-machine direction and which defines an intersection of said first single plane and said second single plane, and wherein each tube lies in a plane which extends radially from the centerline; and wherein the outlet wall is a portion of a cylinder centered about the centerline; and wherein the discharge wall has the shape of a portion of a cylinder which defines a cylindrical axis which is coincident with the centerline.

* * * * *